US010051380B2

(12) United States Patent
Mao et al.

(10) Patent No.: US 10,051,380 B2
(45) **Date of Patent: *Aug. 14, 2018**

(54) SPEAKER

(71) Applicant: AAC Technologies Pte. Ltd., Singapore (SG)

(72) Inventors: Lubin Mao, Shenzhen (CN); Shun Guo, Shenzhen (CN); Fei Hou, Shenzhen (CN); Hongxing Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/417,138

(22) Filed: Jan. 26, 2017

(65) Prior Publication Data

US 2017/0347202 A1 Nov. 30, 2017

(30) Foreign Application Priority Data

May 26, 2016 (CN) ..... 2016 2 0490753 U

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |

(52) U.S. Cl.

CPC ..... *H04R 9/06* (2013.01); *H04R 7/127* (2013.01); *H04R 7/18* (2013.01); *H04R 9/025* (2013.01)

(58) Field of Classification Search

CPC combination set(s) only.
See application file for complete search history.

(56) References Cited

U.S. PATENT DOCUMENTS

2014/0318885 A1* 10/2014 Kim ..... H04R 7/02 181/171
2016/0381481 A1* 12/2016 Wang ..... H04R 9/025 381/400

* cited by examiner

*Primary Examiner* — Amir Etesam
(74) *Attorney, Agent, or Firm* — Na Xu; IPro, PLLC

(57) ABSTRACT

The present disclosure provide a speaker, including a vibrating system and a magnet portion driving the vibrating system, the vibrating system includes a diaphragm and a voice coil driving the diaphragm to vibrate, the diaphragm includes a first fixing portion, a second fixing portion and a vibrating portion connected between the first fixing portion and the second fixing portion, the first fixing portion is fixed on the magnet portion, the second fixing portion is fixed on the frame, the vibrating portion includes a vibrating main portion and a first suspension and a second suspension provided at two ends of the vibrating main portion, the vibrating main portion vibrates at a side of the magnet portion under driving of the voice coil, the magnet portion is provided with an avoiding step at a position corresponding to the first suspension so as to avoid vibration of the first suspension.

5 Claims, 7 Drawing Sheets

SPEAKER

TECHNICAL FIELD

The present disclosure relates to the field of electro-acoustic converting and, in particular, to a speaker for a portable mobile electronic product.

BACKGROUND

With the arrival of mobile Internet era, the number of smart devices is increasing gradually. Among numerous mobile devices, cellphone is the most common and portable mobile terminal device. At present, a cellphone already has diversified functions, an important function thereof is high quality music play, the speaker in the cellphone is one of the necessities for high quality music play.

Existing speaker generally includes a vibrating system composed of a diaphragm and a dome, and a magnet, the vibrating system covers the magnet, and vibrating space is reserved between the vibrating system and the magnet, the vibrating space is used to meet the amplitude requirements of the vibrating system.

However, being limited by the magnet, more space needs to be reserved above the magnet so as to meet the vibration of the diaphragm. As a result, the speaker cannot be made thin, which cannot meet the requirements of portable mobile electronic products on the components.

Therefore, there is a necessity to provide a new speaker, so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The technical solutions of the present disclosure will be described clearly and completely combining the drawings in the embodiments of the present disclosure, obviously, the described embodiments are only part of the embodiments of the present disclosure, but not all of them. Other embodiments obtained by those skilled in the art without creative work are all belonging to the protection scope of the present disclosure.

Embodiment One

Figure 1:
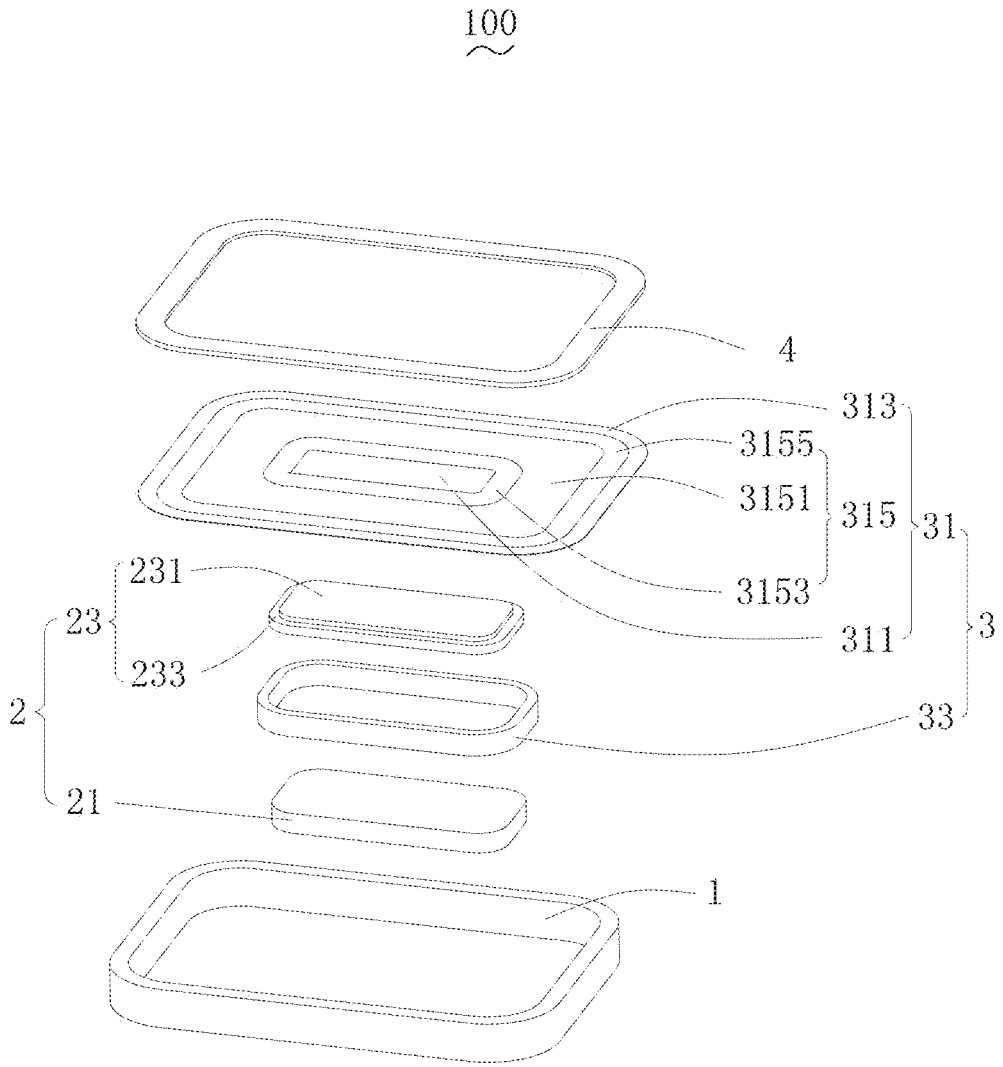
FIG. 1 is a perspective structural exploded view of a speaker in accordance with Embodiment One of the present disclosure.
Figure 2:
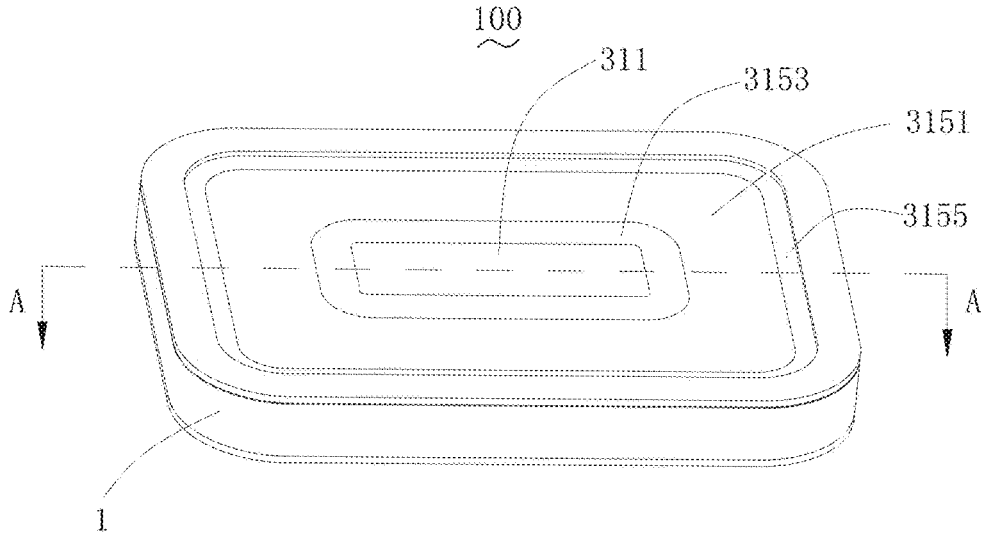
FIG. 2 is a perspective structural view of a speaker in accordance with Embodiment One of the present disclosure.

As shown in FIG. 1 and FIG. 2, the present disclosure provides a speaker 100, including a frame 1, a magnet portion 2 accommodated in the frame 1, a vibrating system 3 held by the frame 1 and driven by the magnet portion 2, and a cover plate 4 which forms accommodating space together with the frame 1 so as to accommodate the magnet portion 2 and the vibrating system 3.

The frame 1 can be a plastic frame; the frame 1 can also be a yoke which, at this time, forms a magnetic circuit system together with the magnet portion 2.

Figure 3:
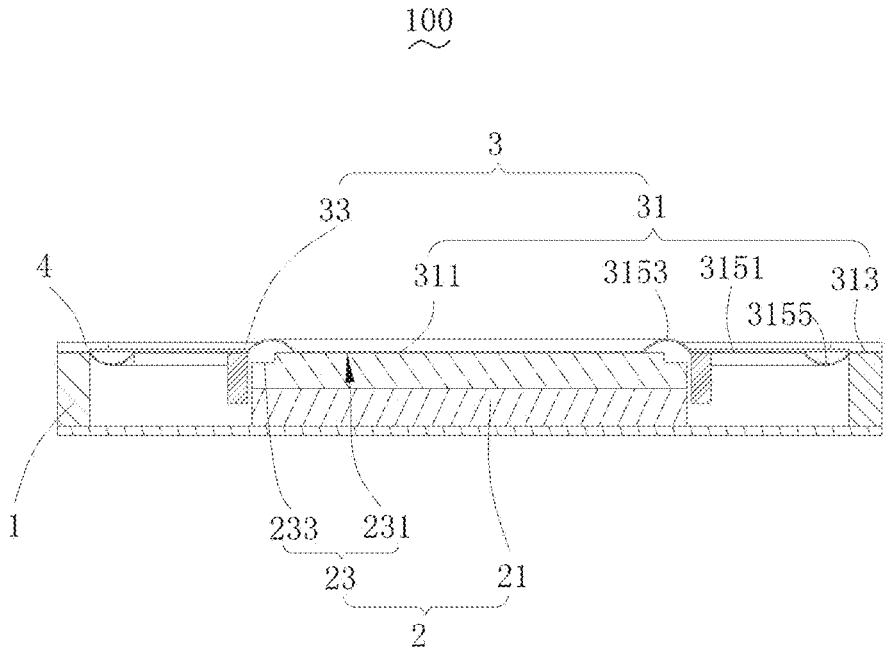
FIG. 3 is a sectional view along A-A line in FIG. 2.

Please refer to FIG. 3, the magnet portion 2 includes a first magnet 21 and a second magnet 23 provided above the first magnet 21, the adjacent first magnet 21 and the second magnet 23 are arranged in a manner such that the poles with a same polarity are opposite to each other, that is, surfaces of the first magnet 21 and the second magnet 23 with a same polarity are fitted with each other, so as to achieve good magnetic circuit properties. In the present embodiment, the S pole surfaces of the first magnet 21 and the second magnet 23 are fitted together, in other embodiments, it may be that the N pole surfaces thereof are fitted, a specific polarity is not limited. The second magnet 23 includes a fitting surface 231 and an avoiding step 233 sunken along a periphery of the fitting surface 231.

Please refer to FIG. 1 and FIG. 3, the vibration system 3 includes a diaphragm 31 and a voice coil 33 driving the diaphragm 31 to sound. The voice coil 33 is provided surrounding the periphery of the magnet portion 2. The diaphragm 31 is fitted on the surface of the frame 1.

The diaphragm 31 includes a first fixing portion 311 at a central position of the diaphragm, a second fixing portion 313 at an edge position of the diaphragm and a vibrating portion 315 connected between the first fixing portion 311 and the second fixing portion 313, the first fixing portion 311 is fixedly fitted on the surface of the second magnet 23, that is, on the fitting surface 231, the second fixing portion 313 is fixedly fitted on the surface of the frame 1.

The vibrating portion 315 includes a vibrating main portion 3151, a first suspension 3153 extending from an inner periphery of the vibrating main portion 3151 and is connected with the first fixing portion 311, a second suspension 3155 extending from an outer periphery of the vibrating main portion 3151 and is connected with the second fixing portion 313, the first fixing portion 311 is fixed on the fitting surface 231, the second fixing portion 313 is fixed on the surface of the frame 1, the voice coil 33 is adhered underneath the vibrating main portion 3151, the vibrating main portion 3151 vibrates at a side of the magnet portion 2 under the driving of the voice coil 33. The avoiding step 233 is provided on the second magnet 23 at a position corresponding to the first suspension 3153, which avoids the vibration of the first suspension 3153.

The first suspension 3153 is provided on the outer periphery of the second magnet 23, an opening thereof is provided downward; the avoiding step 233 can avoid the first suspension 3153, so as to guarantee that there is no collision noise between the first suspension 3153 and the second magnet 23, without affect the magnetic circuit properties. The first suspension 3153 can isolate the air flow between the front vocal cavity and the rear vocal cavity of the speaker 100, meanwhile reducing the polarization generated by the diaphragm 31 during vibration. The voice coil 33 is provided underneath the vibrating main portion 3151 and at the outer periphery of the first suspension 3153, in a vibration direction of the vibrating system 3, the projection of the voice coil 33 does not overlap with the projection of the first suspension 3153. The second suspension 3155 can have a same or a different opening direction with the first suspension 3153.

Embodiment Two

Figure 4:
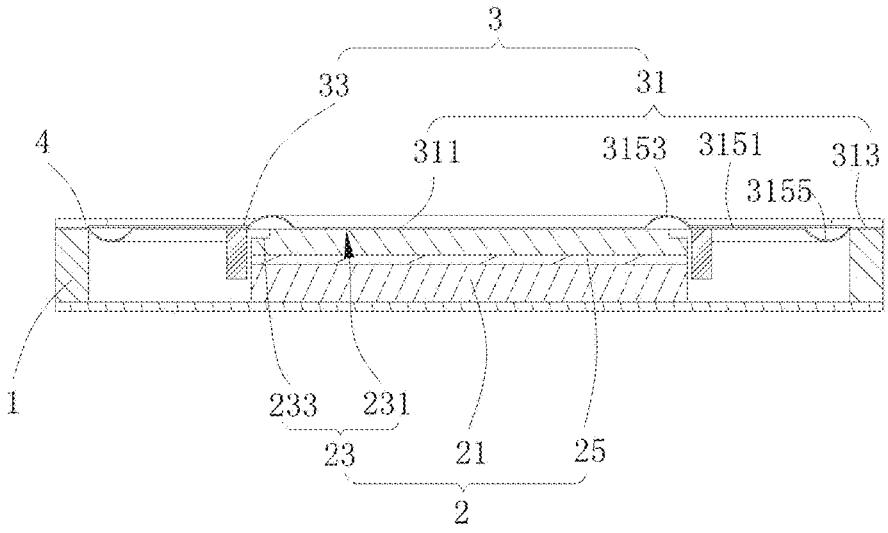
FIG. 4 is a structural schematic view of a speaker in accordance with Embodiment Two of the present disclosure.

Please refer to FIG. 4, in which modification is made to the above speaker 100, the magnet portion 2 further includes a pole plate 25 clamped between the first magnet 21 and the second magnet 23. The pole plate 25 is used for improving magnetic field properties.

Embodiment Three

Figure 5:
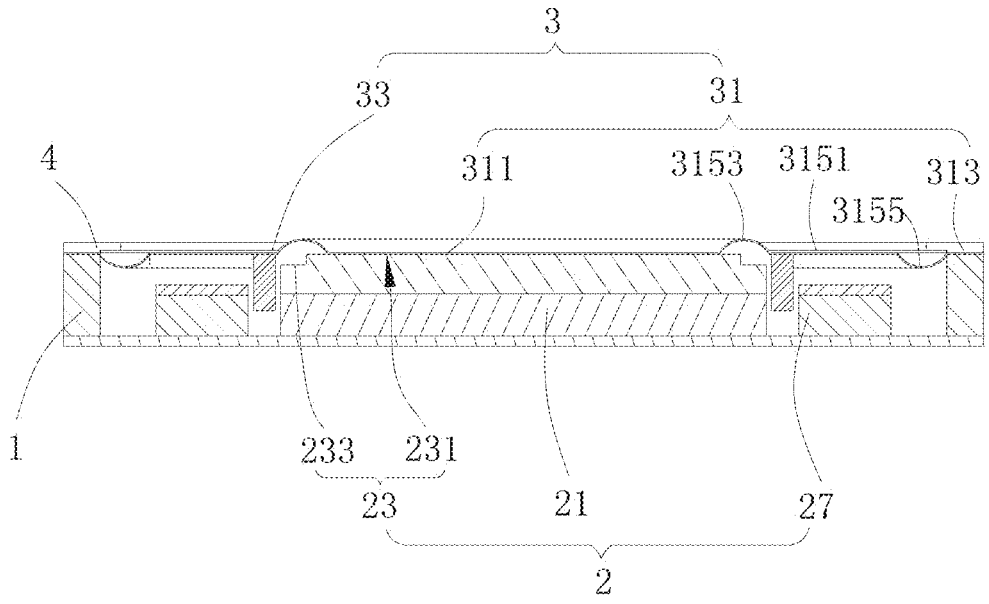
FIG. 5 is a structural schematic view of a speaker in accordance with Embodiment Three of the present disclosure.

Please refer to FIG. 5, in which modification is made to the above speaker 100, the speaker 100 further includes a plurality of auxiliary magnets 27 provided at periphery of the magnet portion 2, the auxiliary magnets 27 form a magnetic gap in between with the magnet portion 2. The voice coil 33 is hung in the magnetic gap between the magnet portion 2 and the auxiliary magnet 27. The auxiliary magnet 27 is used for improving magnetic field properties.

Embodiment Four

Figure 6:
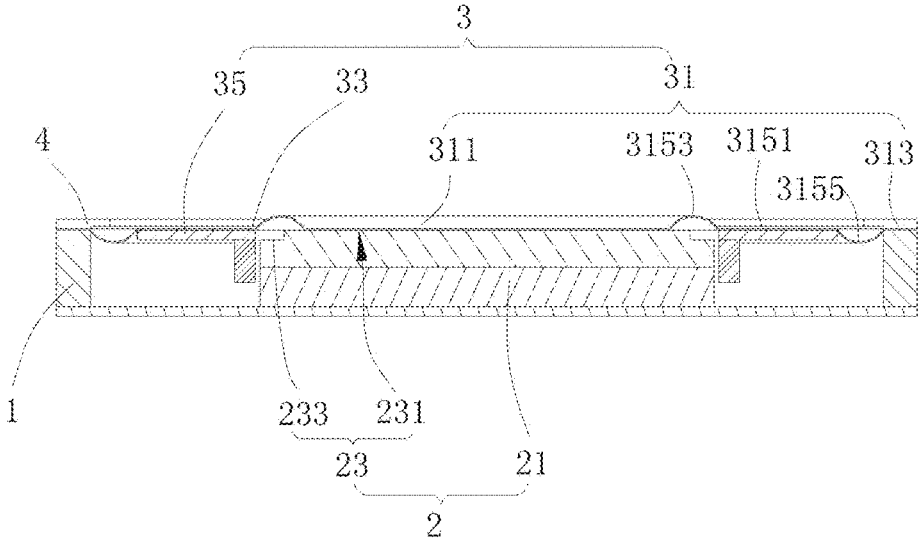
FIG. 6 is a structural schematic view of a speaker in accordance with Embodiment Four of the present disclosure.

Please refer to FIG. 6, in which modification is made to the vibrating system 3, the vibrating system 3 further includes a dome 35, the dome 35 is of a ring shaped structure, which is fitted on a lower surface of the vibrating main portion 3151.

Embodiment Five

Figure 7:
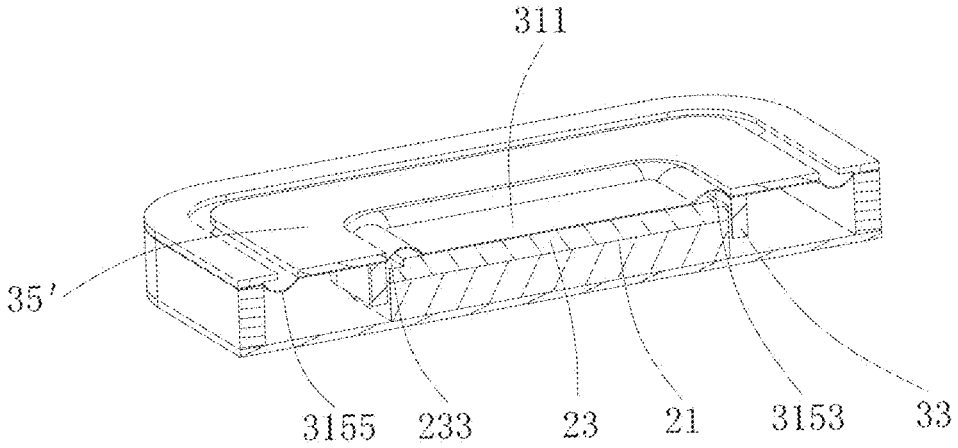
FIG. 7 is a structural schematic view of a speaker in accordance with Embodiment Five of the present disclosure.

Please refer to FIG. 7, in which modification is made to the vibrating system 3, the vibrating system 3 further includes a dome 35', the dome 35' is of a ring shaped structure, which is fitted on an upper surface of the vibrating main portion 3151.

Comparing with the related art, in the speaker 100 provided by the present disclosure, since the vibrating main portion 3151 is vibrating at the side of the magnet portion 2, the diaphragm 31 vibrates without being limited by the thickness of the magnet portion 2, thus the component can be made thin, which effectively meets the requirements of portable electronic products on a lighter and thinner structure of the speaker 100; moreover, the design of the avoiding step 233 avoids collision between the first suspension 3153 and the second magnet 23, which can effectively improve the tone quality of the speaker 100.

The above merely shows embodiments of the present disclosure, it should be noted that, improvements can be made by those skilled in the art without departing from the inventive concept of the present disclosure, however, these shall belong to the protection scope of the present disclosure.

What is claimed is:

1. A speaker, comprising:

a frame;

a vibrating system held by the frame, the vibrating system comprises a diaphragm and a voice coil driving the diaphragm to sound; and a magnet portion accommodated in the frame and drives the vibrating system;

wherein the diaphragm comprises a first fixing portion provided at a central position of the diaphragm, a second fixing portion provided at an edge position of the diaphragm and a vibrating portion connected between the first fixing portion and the second fixing portion, the vibrating portion comprises a vibrating main portion, a first suspension extending from an inner periphery of the vibrating main portion and is connected with the first fixing portion, a second suspension extending from an outer periphery of the vibrating main portion and is connected with the second fixing portion, the first fixing portion is fixed on the magnet portion, the second fixing portion is fixed on the frame, the vibrating main portion vibrates at a side of the magnet portion under driving of the voice coil, the magnet portion is provided with an avoiding step so as to avoid vibration of the first suspension.

2. The speaker as described in claim 1, wherein the magnet portion comprises a first magnet and a second magnet provided above the first magnet, the first magnet and the second magnet are arranged in a manner such that poles with a same polarity are opposite to each other, the first fixing portion is fitted on a surface of the second magnet, the avoiding step is provided on the second magnet.

3. The speaker as described in claim 2, wherein the magnet portion further comprises a pole plate, which is clamped between the first magnet and the second magnet.

4. The speaker as described in claim 1, wherein the diaphragm further comprises a dome, the dome is fitted on an upper surface or a lower surface of the vibrating main portion.

5. The speaker as described in claim 1, wherein the speaker further comprises an auxiliary magnet provided at a periphery of the magnet portion, the auxiliary magnet can form a magnetic gap in between with the magnet main portion, the voice coil is hung in the magnetic gap.

* * * * *